United States Patent [19]

Stolov et al.

[11] Patent Number: 4,696,347

[45] Date of Patent: Sep. 29, 1987

[54] ARRANGEMENT FOR PROPULSION LIQUIDS OVER LONG DISTANCES

[76] Inventors: Michael Stolov; Sara Stolov; Adi Stolov; Ilana Stolov-Hecht, all of 25 Hapoel Street, Nof-Yam, Herzlia 46 105, Israel

[21] Appl. No.: 830,473

[22] Filed: Feb. 18, 1986

[30] Foreign Application Priority Data

Feb. 4, 1986 [IL] Israel ..... 77783

[51] Int. Cl.[4] ..... A62C 17/00; A62C 19/00; F42B 11/24; F42B 13/14

[52] U.S. Cl. ..... 169/46; 89/8; 102/365; 102/473; 102/501; 124/81; 124/82; 169/33; 169/36; 169/54

[58] Field of Search ..... 169/33, 36, 54, 46, 169/47; 124/81, 82, 71; 102/501, 473, 365; 89/8

[56] References Cited

U.S. PATENT DOCUMENTS

| | | | |
|---|---|---|---|
| 790,664 | 5/1905 | Smith | 89/8 X |
| 2,182,369 | 12/1939 | Barron | 124/81 |
| 2,397,800 | 4/1946 | McArthur | 89/8 |
| 2,703,527 | 3/1955 | Hansen | 102/365 |
| 3,833,064 | 9/1974 | Ranney, Jr. | 169/36 X |
| 4,094,246 | 6/1978 | Travor | 102/365 |
| 4,285,403 | 8/1981 | Poland | 169/36 X |
| 4,419,936 | 12/1983 | Coates et al. | 102/501 X |

FOREIGN PATENT DOCUMENTS

| | | | |
|---|---|---|---|
| 2542485 | 4/1977 | Fed. Rep. of Germany | 169/36 |
| 2658459 | 6/1978 | Fed. Rep. of Germany | 169/54 |
| 1311601 | 1/1962 | France | 169/36 |
| 936942 | 6/1982 | U.S.S.R. | 169/36 |

*Primary Examiner*—Andres Kashnikow
*Attorney, Agent, or Firm*—Browdy and Neimark

[57] ABSTRACT

An arrangement for propelling liquids over long distances involves enclosing liquid in a plurality of thin plastic spheres having a dimpled surface. The liquid containing spheres are propelled over substantial distances by shooting them from a pipe by means of compressed air.

20 Claims, 8 Drawing Figures

ARRANGEMENT FOR PROPULSION LIQUIDS OVER LONG DISTANCES

BACKGROUND OF THE INVENTION

Here is disclosed a new method for extinguishing fire at a very long distance, in inaccesible places, where the conventional fire-hose with nozzle cannot reach. The arrangement can also be used for irrigation of farmlands which are accessible only with difficulty. The machine proposed in the present invention, using a hard enveloped liquid can destroy dangerous objects at a distance of several miles. Up to date it was possible to do it by means of a flame-thrower, but only at a distance of about 100 feet.

SUMMARY OF THE INVENTION

Hard Enveloped Liquid—"HEL"— is a new condition of liquid in which it has new mechanical properties, very useful in many fields of technology and life circumstances. According to the present invention, a liquid in the new form, can be thrown over large distances in large quantities to inaccesible or difficultly accesible areas. It is useful for extinguishing fire in flaming high buildings, or in a flaming tanker, or in a factory, or in a forest, etc. Huge quantities of water being in a new form can be delivered without pipes over large distances for agriculture purposes. In another embodiment, large quantities of flammable liquids can be thrown over large distances to burn and destroy dangerous inaccesible places, as ruins or infectious objects and areas. In the new form liquid can be stored a very long time without evaporation. Moreover, the transport of the liquid in this form, can be realized in boxes and regular trucks, instead of special cisterns.

DESCRIPTION OF THE PREFERRED EMBODIMENTS

Figure 1:
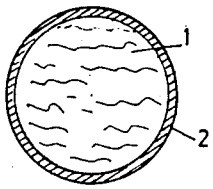
FIG. 1 shows a sectional view of a simple form of a hard enveloped liquid.
Figure 2:
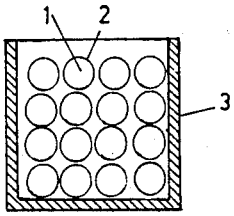
FIG. 2 shows a sectional view of a container-box, which can be used for storage or transport of the hard enveloped liquid, according to present invention.

According to the previous knowledge, liquids are stored and transported by means of round containers-cisterns, tankers or pipes. New, according to the present invention, a liquid for example water, is enclosed in a plurality of envelopes made preferable from a thin plastic material. In the simplest form the envelope can be in the form of a "ping-pong" ball, as it is shown in FIG. 1. Here 2 is the plastic ball, 1 is the enclosed water. A large quantity of water enclosed in the thin plastic envelopes can be stored or transported in a simple box 3, as it is shown in FIG. 2. This is an advantage in cases where cisterns or tankers are absent. Although liquids are stored and transported in different plastic containers today, the liquid enclosed in an envelope of special form, according to the present invention, has new mechanical properties, useful in many fields of technology and different life circumstances. The main advantage is, that liquid, for example water, being enveloped in plastic balls of special form, can be easily thrown over a much larger distance, as it is done today by means of a fire-hose and nozzle.

To understand the said above, some analytical consideration will be made. A jet of water shown in FIG. 5, directed by means of a nozzle 4 at a given angle in vacuum, would reach the earth in point "a" according to the formula:

$S=2Vo^2\times \text{Sin}\ \alpha\times \text{Cos}\ \alpha/g$ where:

S is the distance to the point "a"

Figure 5:
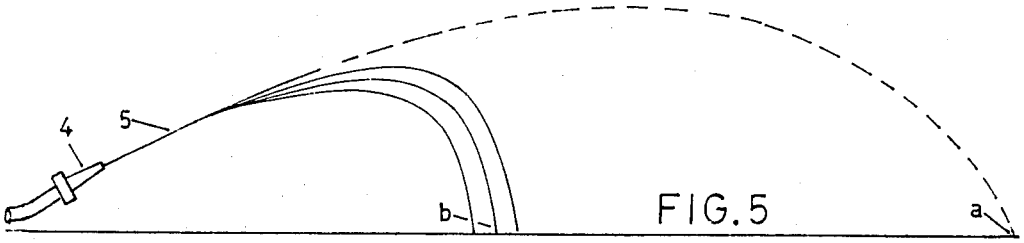
FIG. 5 shows a jet of liquid, as it is known using previous technology.

Vo is the initial velocity of the jet of water 5 is FIG. 5

$g=9.8\ m/sec^2$ $\alpha$=the angle of the nozzle 4

According to the above formula, the longest distance can be achieved by an angle=45°. But in the practice, because of the air resistance, a jet of water, after a short distance, about 100 feet become divided in a plurality of very small droplets, which fall down, as in FIG. 5 in the area "b". Each droplet can be considered, as a small ball. In vacuum all balls, little or large behave identical and the above cited formula is correct. In reality, an important part is played by the resistance of the air. The air resistance causes considerable slow down of the velocity of a ball, thus shortening its flight distance. The influence of air resistance decreases as the size of the ball increases. This happens, because the mass of the ball increases, as its cube of the diameter ($d^3$), while the force of the air resistance increases, as the area of the cross-section, hence, as the square of the diameter ($d^2$). So the ratio of the force of the air resistance to the mass of the ball decreases with increase of the diameter (size) of the ball. Now, the distance $S_1=kSd^3/d^2=kSd$ (The mass of the ball is a part of the pushing kinetic energy$=m.v^2/2$) In other words, a bigger ball shows a longer flight distance. Now is clear, that a plastic envelope like a "ping-pong" ball filled with water, will fly a longer distance than a droplet. An envelope the size of a foot-ball filled with water will considerably increase the flight ability and deliver water at a long distance. Unfortunately not all long flight problems are at this point solved and an additional research was necessary.

Figure 6:
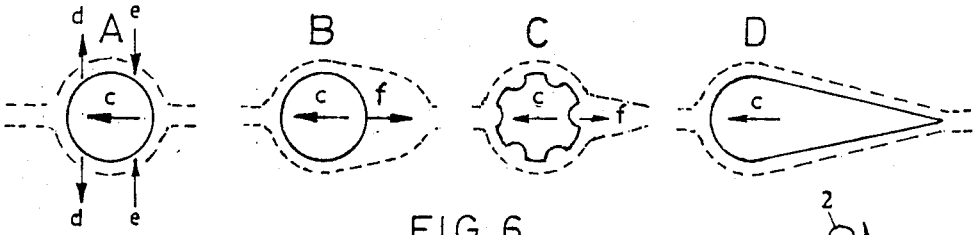
FIG. 6 shows the behaviour of envelopes of basical shapes in an air-current.

It was found, that an envelope filled with a liquid, having a smooth surface behaves strangely after a certain distance. It suddenly brakes and falls to ground. The explanation of this phenomenon is illustrated in FIG. 6. In FIG. 6-A, a ball having a smooth surface, moves from right to left, as it is shown by the arrow "c", with a low velocity. In this case the ball is opening a three dimension hole in the air, executing work against the atmospheric pressure, as is shown by the arrows "d". Behind the ball, the air is closing the hole and the atmospheric pressure works in opposite direction "e" pushing the ball in the same direction, as arrow "c". Hence the resulting air resistance, at low speed, is zero, or near to zero. Increasing the speed of the ball, suddenly a critical point is reached, when the speed of the air, which closes the hole after the ball, become less than the speed of the ball. After the ball there remains a space of dropped pressure. The space of dropped pressure is marked in FIG. 6-B, by interrupted lines. At this moment appears a force "f" pulling the ball in the opposite direction, which is the reason that the ball at a certain velocity suddenly brakes and falls to the ground.

Figure 3:
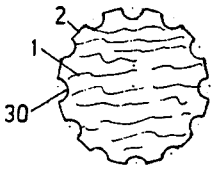
FIG. 3 is a sectional wiev of an envelope, according to the present invention.
Figure 7:
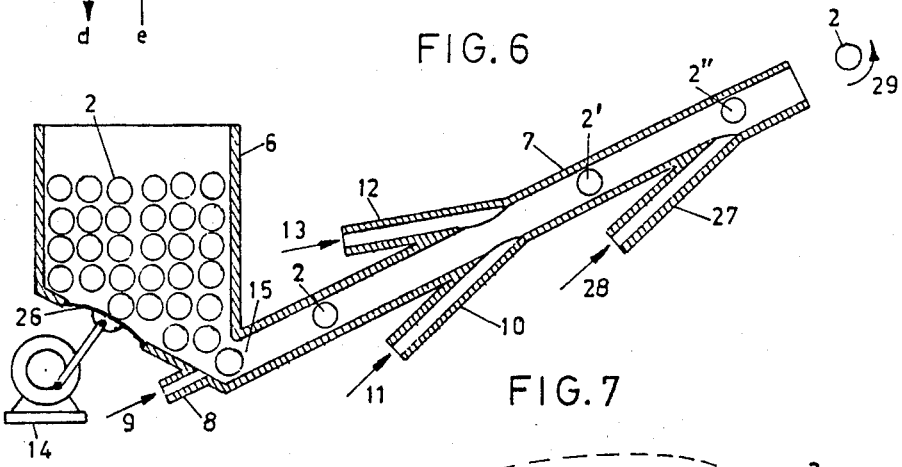
FIG. 7 is a sectional view of a new machine using Hard Enveloped water for extinguishing fire, or for irrigation of farms.

A well known solution is given in FIG. 6-D, where the front-part of the envelope is spherical and the back-part has a conic form. In this form the air, after the envelope moving in direction "c", has enough time to close the air-hole and no space of dropped pressure occurs. But with this shape it is impossible to handle large quantities of liquid, because it needs stabilizing-folding wings, and it is difficult to store and launch. For extremely long distances an aerodynamic shape of the envelopes is still necessary. For the present invention was chosen a solution which does not have the above disadvantages. The envelopes have an uneven surface, as it is shown in FIG. 3. They have a spherical form with a plurality of dimples 30 on the outward surface. As is shown in FIG. 6-C, the dimples on the surface of the ball are pulling air from the front side to the back side, decreasing considerably the size of the space where pressure drop occurs. Hence the force in the opposite direction appears incomparable weaker and cannot equalize the kinetic energy in the moving direction "c". An enveloped water ball of this shape does not brakes during the flight and is able to reach a distance at least five time greater than an enveloped water ball having a smooth surface. A machine for throwing over a large distance, the above envelopes filled with a liquid in large quantities is shown in FIG. 7. Here, in the box 6 are stored liquid filled envelopes. The motor 14 makes the membrane 26 vibrate, causing one ball at a time to fall down in the area 15 of the pipe 7. A high pressure air current 9 pushes an envelope 2 filled with a liquid up the pipe 7, delivering it a initial velocity. For this purpose is used an additional pipe 8. By means of at least one pair of pipes 10 and 12, high pressure air pulses 11 and 13, (preferable electronically controlled) accelerates the ball 2' delivering it at a high velocity. An additional air pulse 28, through the pipe 27, which is arranged at the lower side, near the end of the pipe 7, will deliver to the ball 2" a rotation in the vertical plane-up, as it is shown by the arrow 29. This additional rotational movement lifts the ball during the flight and increases the distance of the liquid filled envelope at least twice. The pipe 7 is widened in the end part at the lower side, so friction between a envelope 2" and pipe 7 occurs only at the higher side of pipe 7, causing a rotational movement of filled envelopes.

Figure 4:
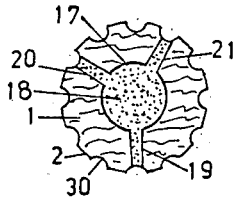
FIG. 4 is a sectional wiev of another form of an envelope, according to the present invention.

Using in the machine of FIG. 7 envelopes like in FIG. 3 filled with water 2, can be employed for extinguishing fire at long distances, where the access is impossible, for example in very high flaming buildings or, in flaming tankers, or in a factory, or in a flaming forest, etc. In this case the envelopes should be made from a flammable plastic. The plastic envelopes entering the fire, burn out releasing huge quantities of water which drops extinguishing the fire. Clearly, that the envelopes can be made from other materials. For extinguishing fire of flammable materials, as for example oil, an improved envelope is according to the present invention is shown in FIG. 4. Here in the middle of the envelope 2 a second envelope 17 is held by means of several thin supports 19, 20 and 21. The envelope in the middle 17 is filled with air, or gas, or explosive material 18, which expands, or explodes dispersing a large water cloud containing an ennormous quantity of water droplets. Because of the high heat capacity of water, the temperature of the region drops rapidly extinguishing the flames.

In an other embodiment, the said liquid is frozen in a plurality of balls, without envelopes. Reaching an area of higher temperature after the flight, the said balls are thawing or dissolving realising the liquid. In this case the freezing machine should be placed near the arrangement of FIG. 7.

The hard enveloped liquid can be used in agriculture. Here with an arrangement like shown in FIG. 7, water can be delivered over a long distance, without pipes or aeroplanes. In this case the envelopes can be made from a frail crumbling material, containing also a fertilizer-compound. After the flight, the ball will fall down to the ground crashing and dispersing water and or fertilizer. The envelopes can be made also from dissolving or thawing materials. This arrangement can also be employed for splashing liquids with chemicals to secure farms against insects, or infectious objects. The method shown in FIG. 7, can be used for delivering liquids from ship to ship, from aircraft to aircraft, from spaceship to spaceship etc.

Figure 8:
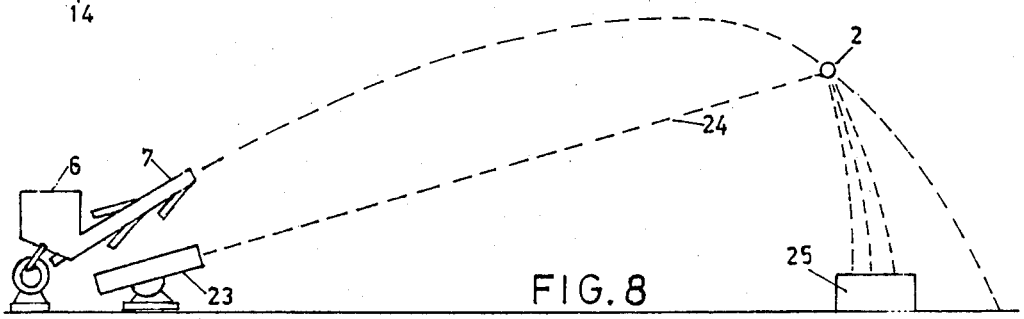
FIG. 8 is a sectional view of a new machine for flame throwing over very long distances.

A useful application of the present invention is an arrangement to burn and destroy inacessible dangerous objects at a long distance, like ruins, infections areas etc. The arrangement for this purpose is shown in FIG. 8. The main part of the machine is made identical, as the arrangement of FIG. 7. The envelopes are here made from a flammable material (plastic) and they are filled with a flammable liquid, for example with oil. A laser 23, directs a beam to an envelope 2 at desired distance setting fire to it. The envelope burning disperses a huge quantity of flaming drops. As it was already explained above small drops cannot travel far. They, simply stop in the point, where the fire was set. Hence a flaming rain will fall down on the object 25. If even the object 25 is made from concrete, the high temperature, which occurs in result of the flaming rain, will release the binding water and the concrete will collapse.

In this way an enormous quantity of thermal energy can be transmited over very long distances and concentrated on a desired object 25. It is clear, that in one embodiment this energy can be employed in a hard accesible electric power station. Undoubtedly, many other applications can be found for thermal energy, that can be transmited over long distances and concentrated at a desired place. It is clear that's why the envelopes and filling liquids are flammable materials, the laser does not need to be of extraordinary power. Instead of a laser, a machine-gun shooting burning or high temperature bullets can be employed. Clearly, that even very high objects on the way, will not prevent to transmit large quantities of thermal energy over long distances. If the envelopes are made from inflammable material and will be filled with water, than the arrangement of FIG. 8, can be used for irrigation, wherein the laser, or gun will release the water at the desired distance.

What is claimed is:

1. An arrangement for propelling substances in large quantities over long distances, comprising a substance to be propelled in large quantities over long distances, said substance being in the form of a plurality of spheres, each sphere having a generally spherical form with a plurality of dimples on the outer surface thereof;

a launching pipe having a first inlet means for continuously receiving said spheres, a second inlet means for feeding compressed gas to said launching pipe to drive spheres of said substance within said launching pipe and therethrough, and an outlet through which said spheres are driven by the compressed gas;

a mechanical feeder for feeding the spheres to said first inlet of said launching pipe;

means for feeding highly compressed gas to said second inlet of said launching pipe;

whereby a jet of said spheres is thrown out through the outlet of said pipe at a high velocity in the desired direction, the dimples on said spheres allowing the substance to reach long distances.

2. An arrangement according to claim 1, wherein said means for feeding highly compressed gas is an air compressor.

3. An arrangement according to claim 1, further comprising means for disrupting said spheres at a great distance from said launching pipe after said spheres have been launched.

4. An arrangement according to claim 3, wherein said means for disrupting said spheres comprises a laser, the beam of which is directed to cross said jet of spheres, to effect scattering of said substance at a desired distance and height with high accuracy.

5. An arrangement according to claim 3, wherein said means for disrupting said spheres comprises a machine-gun for shooting bullets which cross the path of said jet of spheres at a desired distance and height, to effect scattering of said substance at the desired location with high accuracy.

6. An arrangement according to claim 1, wherein said spheres comprise a plurality of thin envelopes of spheric form, with said substance being encapsulated therewithin.

7. An arrangement according to claim 6, wherein said encapsulated substance comprises water.

8. An arrangement according to claim 1, wherein said encapsulated substance comprises a flammable liquid.

9. An arrangement according to claim 1, wherein said encapsulated substance comprises sand.

10. An arrangement according to claim 1, wherein said encapsulated substance comprises a chemical.

11. An arrangement according to claim 1, wherein said spheres are formed of frozen liquid.

12. An arrangement according to claim 1, wherein said mechanical feeder is a vibratory feeder.

13. An arrangement according to claim 1, wherein said launching pipe further comprises means to cause said spheres to rotate in a vertical plane and effect lift of said spheres during flight causing a lengthening of the flight distance of said spheres.

14. An arrangement according to claim 13, wherein said means for causing said spheres to rotate in the vertical plane and effect lifting thereof during flight to cause a lengthening of the flight distance, comprises a widened portion at the outlet of said launching pipe and an additional inlet means for the feeding therethrough of compressed gas at said widened portion.

15. An arrangement according to claim 14, wherein said launching pipe is further provided with additional compressed gas inlet means along the length of said pipe, constituting means to deliver high pressure gas pulses for increasing the flight velocity of said spheres.

16. An arrangement according to claim 1, wherein said launching pipe is further provided with additional compressed gas inlet means along the length of said pipe, constituting means to deliver high pressure gas pulses for increasing the flight velocity of said spheres.

17. A method of propelling substances in large quantities over long distances, comprising providing the substances to be propelled in the form of spheres having a plurality of dimples on the outer surfaces thereof;

feeding said dimpled spheres continuously to an inlet of a launching pipe, said launching pipe having an outlet for the passage therethrough of said dimpled spheres;

feeding highly compressed gas to a second inlet of said launching pipe and thereby throwing out through said outlet a jet of dimpled spheres at a high velocity in the desired direction, whereby the dimples on said spheres allow said spheres to travel a long distance.

18. A method according to claim 17, further comprising disrupting said spheres to scatter said substance at a point in the air above a desired target.

19. A method according to claim 18, wherein said dimpled spheres comprise thin spheric envelopes filled with said substance, and wherein said disruption is effected by shooting a laser beam or bullets at said spheres at a point generally above said target.

20. A method according to claim 17, wherein said spheres comprise envelopes of spheric form filled with said substance selected from the group consisting of water, flammable liquid, sand, chemicals, and mixtures thereof.

* * * * *